US010927423B2

(12) United States Patent
Van Quathem et al.

(10) Patent No.: US 10,927,423 B2
(45) Date of Patent: Feb. 23, 2021

(54) METHOD FOR PROCESSING SKINS

(71) Applicants: Piet Van Quathem, Ghent (BE); Frank Vancauwenberghe, Aalter (BE)

(72) Inventors: Piet Van Quathem, Ghent (BE); Frank Vancauwenberghe, Aalter (BE)

( * ) Notice: Subject to any disclaimer, the term of this patent is extended or adjusted under 35 U.S.C. 154(b) by 536 days.

(21) Appl. No.: 15/516,532

(22) PCT Filed: Oct. 1, 2015

(86) PCT No.: PCT/IB2015/057529

§ 371 (c)(1),
(2) Date: Apr. 3, 2017

(87) PCT Pub. No.: WO2016/051378

PCT Pub. Date: Apr. 7, 2016

(65) Prior Publication Data

US 2018/0023151 A1 Jan. 25, 2018

(30) Foreign Application Priority Data

Oct. 1, 2014 (BE) ..... 2014/5004

(51) Int. Cl.
*C14C 1/02* (2006.01)

(52) U.S. Cl.
CPC ..... *C14C 1/02* (2013.01)

(58) Field of Classification Search
CPC .... C14C 1/00; C14C 1/02; C14C 1/04; C14C 9/00; C14C 9/02
See application file for complete search history.

(56) References Cited

U.S. PATENT DOCUMENTS

| | | | | | |
|---|---|---|---|---|---|
| 2,354,200 | A * | 7/1944 | Cutler | C14B 1/26 | 34/284 |
| 2,438,150 | A | 3/1948 | Cutler | | |
| 3,292,271 | A * | 12/1966 | Hopkins | C14C 1/00 | 34/342 |
| 4,224,029 | A * | 9/1980 | Heinz | C14C 13/00 | 8/94.1 R |
| 2005/0003096 | A1 | 1/2005 | Klosowski et al. | | |
| 2006/0137212 | A1* | 6/2006 | Nomine | F26B 5/06 | 34/284 |

FOREIGN PATENT DOCUMENTS

| | | | |
|---|---|---|---|
| DE | 1444993 | A1 | 1/1969 |
| GB | 572367 | A | 10/1945 |
| JP | S59185607 | A | 10/1984 |
| WO | 2005007897 | A1 | 1/2005 |
| WO | 2011067780 | A1 | 6/2011 |

OTHER PUBLICATIONS

Belgium Search Report for corresponding Belgium Application No. BE201405004, dated Jul. 1, 2015.
International Search Report for corresponding International PCT Application No. PCT/IB2015/057529, dated Mar. 2, 2016.
Japanese Office Action from JP Application No. 2017-537028, dated Mar. 5, 2019.

* cited by examiner

*Primary Examiner* — Shaun R Hurley
(74) *Attorney, Agent, or Firm* — Workman Nydegger

(57) ABSTRACT

A method for processing skin, the method comprising freezing of the skin before freeze-drying this, freeze-drying of the skin and application of an impregnation material into the freeze-dried skin.

14 Claims, 4 Drawing Sheets

METHOD FOR PROCESSING SKINS

AREA OF APPLICATION OF THE INVENTION

The present invention relates in general to the processing of animal skins. The invention furthermore concerns a method for processing skins.

The invention is used above all in the leather industry.

BACKGROUND OF THE INVENTION

For thousands of years, people have been treating the skins of animals in order to use these in different objects. The most common process for treating animal skins for use thereof is tanning of the skins into leather. During tanning of the skin, the proteins in the skin are rendered indissoluble. Often during tanning, hydrolysable polymers of gallic acid or catechins are used as tanning substances. After tanning, various secondary treatment stages are carried out such as pressing, greasing, bleaching and drying.

Conventional tanning is a proven process which gives usable skins. However it has the disadvantage that it is a time-consuming process and causes substantial pollution into waste water. In addition, large installations are required to perform the process completely.

GB 572 367 describes the use of freeze-drying on tanned and untanned skins. Firstly, the document describes the use of freeze-drying on tanned skins in order to eliminate the remaining moisture. Secondly, the use of freeze-drying on untanned skins is described here as a pre-treatment for drying the skins. This ensures a time saving compared with conventional processes. After this step, the skins are tanned as normal.

U.S. Pat. No. 2,438,150 describes the effect of freeze-drying on untanned skins. Freeze-drying is here used both before and after conventional tanning. Also, the effect of freeze-drying on the fibre structure is discussed.

WO 2011 067 780 describes the use of freeze-drying on site. The fresh animal skins are temporarily brought into a lyophilisator and locally freeze-dried. The resulting skins are then more suitable for transport to the final tannery. The storage of skins is also guaranteed for longer.

The methods described in the above texts have the disadvantage that the skins must still be processed using conventional tanning steps. Although freeze-drying has already been discovered as a pre-treatment for tanning, conventional tanning steps must still be followed, often in a delocalised, time-consuming and polluting manner.

SUMMARY OF THE INVENTION

An object of embodiments of the present invention is to provide a method which processes skins and makes it possible to obtain usable skins in a local, time-advantageous and ecological manner. The above object is achieved by the steps according to the present invention.

In a first aspect, the present invention provides a method for processing skins, in particular skins of animals such as mammals, birds, reptiles, amphibia or fish. The method according to the invention comprises:

freezing the skin before freeze-drying this, freeze-drying the skin, and applying an impregnation material to the freeze-dried skin.

In embodiments of the first aspect, the invention proposes a method wherein animal skins are processed in such way that, over a long time period, they display no signs of rotting and are usable for further applications. A "long time period" means that the skins do not rot for several years. The term "usable for other applications" means that the skins treated in this way can be used further for different applications, e.g. for objects such as shoes, clothing articles, interior applications etc.

The process is characterised in that the animal skin, free from flesh and fat, is first frozen and then brought into a lyophilisator, or frozen in the lyophilisator before freeze-drying begins. During a sufficient period, the skin is freeze-dried so that the moisture is almost completely removed from the animal skin via sublimation. The skin is then bone dry. Then the resulting material is brought into contact with an impregnation material before it can reabsorb moisture. This impregnation material fills the cavities obtained by freeze-drying.

It is an advantage of following the method according to the present invention that it is particularly suitable for processing animal skins in a rapid and efficient manner. This can take place in a localised method, wherein all steps carried out in one physical place. Furthermore it is an ecological method, wherein little waste water is produced. Thus the process is suitable for use at various locations. At the site where animals are slaughtered or fish filleted, a compact installation may deliver usable skins very time-efficiently. This process in this respect has an advantage over conventional processes in that it can be used at many different places and that the many delocalised steps can be performed on one site.

By freeze-drying the skin, a dry fibre structure is obtained. In contrast to conventional tanning where the original fibre structure is damaged in order to make the leather flexible, in a method according to the present invention, freeze-drying removes the moisture from the skin but the fibre structure remains in place. The cavities in this fibre structure are then filled or coated with impregnation material.

The fibre structure of the skin can be influenced by suitable choice of process parameters. Freeze-drying ensures only a limited damage to the fibre structure. Freeze-drying allows the fibre integrity to be retained, in comparison with conventional tanning where this is not the case and the fibre structure is damaged.

Freeze-drying and impregnation according to the present invention allow the elimination of conventional tanning steps. It is a particular feature of embodiments of the present invention that freeze-drying of the skin replaces the conventional tanning steps. In other words, according to the present invention it is not necessary to perform conventional tanning steps, as well as freeze-drying, in order to obtain a stable and rot-free product. The advantages of this are two-fold: firstly freeze-drying is a far less time-consuming step than tanning, and secondly freeze-drying is far less polluting.

The step of prior freezing of the skin before freeze-drying determines the size of the pores which will be present in the freeze-dried skin. If the skin is not frozen in a preceding step, but freeze-dried directly, no pore network is produced in the freeze-dried skin. By freezing before freeze-drying, pores or cavities are produced in the skin. These ensure a thickening of the material, for example a thickening to around twice the original thickness. Rapid freezing and low temperatures give smaller pores than slow freezing and high temperatures. This means that, by choice of process parameters for the optional preceding freezing step, pores with different dimensions can be created in the skin, which affects the physical properties of the finally treated skin such as the transparency, tensile strength, shear strength and flexibility.

The dimensions of the pores formed also determine which impregnation medium can be used. The formation of pores benefits the processability of the skin, amongst others due to the increased stretchability and suppleness. A skin which has not been previously frozen is less stretchable and less supple. In addition, a skin which has been frozen before freeze-drying is less susceptible to wrinkling.

In embodiments of the present invention, the skin may for example first be freeze-dried by being dipped in liquid nitrogen. The advantage of this is that this step is easy to perform, wherein cooling takes place very rapidly at a low temperature, which leads to small pores. Alternatively, the skin to be treated can first be brought into a cool room. The size of the pores formed will depend on the type of skin, the temperature of the cool room and the speed with which the skin is cooled.

In a method according to embodiments of the present invention, freeze-drying can take place at a temperature between −20° C. and −180° C., e.g. between −20° C. and −80° C. Preferably, the skin is freeze-dried to a temperature which is at least 10° C. colder than the temperature of the skin at the start of freeze-drying, for example at a temperature which is at least 10° C. colder than the temperature of the deep-frozen skin.

Freeze-drying can take place at low pressure, wherein the low pressure is preferably lower than 15 mbar. The lower the pressure, the lower the temperature will be during the freeze-drying step.

Freeze-drying is thus carried out during a time interval which is sufficient to bring the remaining fraction of moisture in the skin to less than 8% of the total weight of the skin before freeze-drying.

The duration of freeze-drying can be reduced by lowering the low pressure and/or by lowering the temperature.

The impregnation material may be applied to the freeze-dried skin in any suitable manner. Examples are application (550) of the impregnation material in a bath, where applicable under pressure, and/or application (550) of the impregnation to the skin by atomisation, and/or application (550) of the impregnation material by rubbing on the skin, and/or application (550) of the impregnation material to the skin via a foam application. Some impregnation materials can be applied to the skin more easily via a temperature step, for example oils and waxes can be applied to a pre-heated skin, whereby they are more fluid or viscous and consequently easier to draw into the skin, where they set again or become less viscous.

After application of the impregnation material, the impregnated skin may be pressed. Firstly, this presses the impregnation material into the skin, and secondly removes any surplus impregnation material.

According to embodiments of the present invention, the impregnation material is applied at the latest 2 hours, preferably at the latest 30 minutes, preferably immediately after freeze-drying. The closer the freeze-drying step is followed by the impregnation step, the less moisture is absorbed again by the freeze-dried skin. In a particularly advantageous embodiment, freeze-drying and impregnation take place in the same apparatus, so that the steps can follow closely on each other. This has the secondary advantage that the impregnation step can be carried out in the same room, where applicable under pressure. It is even more advantageous if the optional preliminary freezing step is carried out in the same room. Then no transport is required between the cool room where freezing takes place and the room in which freeze-drying takes place, and the deep-frozen skin consequently has the lowest temperature at the start of the freeze-drying. The present invention also provides an apparatus in which the step of freeze-drying and the step of impregnation can be carried out preferably within the same room.

In embodiments of the present invention, the impregnation material may comprise one or more of the following components, acrylates, polyacrylates, polyesters, polyurethanes, silicone materials, polyvinyl alcohols, polyvinyl acetates, polyvinyl chlorides, synthetic resins, starch derivatives, oils, natural resins and natural waxes. The choice of a suitable impregnation material is determined amongst others by the proposed usage. By adding extra silicone for example, a better binding can be obtained and the end material is more hydrophobic. Functional agents may be added to the impregnation material such as colourings, fragrances and/or acrylate dispersions.

In embodiments of the present invention, the skin may be clamped before freeze-drying and/or before cooling. This helps counter shrinkage due to freeze-drying.

A method according to embodiments of the present invention may be used on various types of skins, for example on a skin with a thickness between 200 and 1000 microns.

In embodiments of the present invention, a skin may be soaked before being cooled and/or clamped. This may for example be the case after descaling of the skin. During soaking, the fibres of the skin open (i.e. the spaces between the fibres swell). By using suitable soaking materials, a thicker skin is obtained. The skin may swell for example to a thickness which is 3, 4 or 5 times thicker than the thickness of the skin before soaking. After carrying out the different processing steps, this gives a softer and fleecier skin (e.g. suede). It is namely an advantage of embodiments of the present invention that on freeze-drying, the thickness of the skin is retained. Examples of possible soaking materials are fatty alcohol ethoxylates and fatty alcohol ethersulphates VAE.

In a second aspect, the present invention provides a processed skin obtained by use of the method according to embodiments of the first aspect.

Specific and preferred aspects of the invention are summarized in the attached independent and dependent claims. Features of the dependent claims may be combined with features of the independent claims and with features of further dependent claims as indicated and not merely as expressly presented in the claims.

To summarize the invention and the achieved advantages in relation to the prior art, certain objectives and advantages of the invention are described above. It should be understood however that it is not necessary for all these objectives or advantages to be obtained by each specific embodiment of the invention. Thus for example, specialists may find that the invention can be incorporated or embodied in a manner which achieves or optimises one advantage of a group of advantages as outlined herein, without necessarily achieving other objectives or advantages which may be outlined or suggested herein.

The above and other aspects of the invention will become clear and be explained with reference to the embodiment(s) described below.

BRIEF DESCRIPTION OF THE FIGURES

The invention will now be described further as an example with reference to the attached figures.

Figure 1:
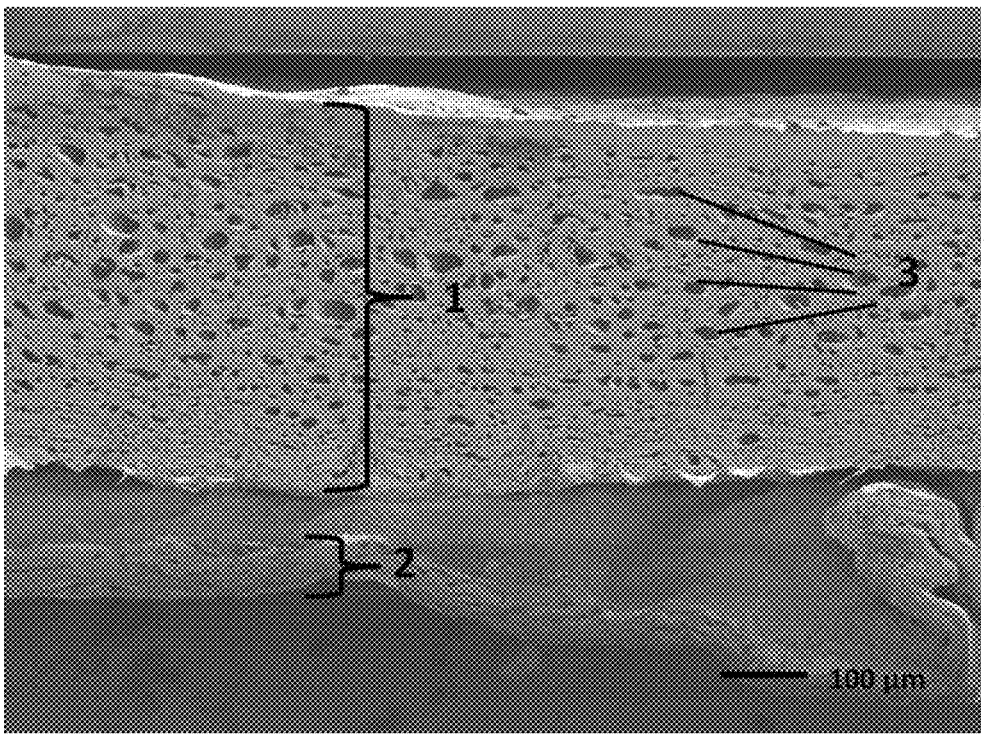
FIG. 1 is a cross section of a freeze-dried salmon skin according to embodiments of the invention. The salmon skin is first cooled to −20° C. and then freeze-dried at a lower temperature of −40° C. as described in example 1. No subsequent impregnation with an impregnation medium was carried out. The photo clearly shows the dermis (1) and epidermis (2) of the fish. The spongy structure with holes (3) of the dermis and epidermis is visible.

The figures are merely diagrammatic and not limitative. The dimensions of some parts in the figures may be exaggerated and are not shown to scale for illustrative purposes. Dimensions and relative dimensions do not necessarily correspond to actual embodiments of the invention.

Reference numbers in the claims should not be interpreted as limiting the scope of protection.

The same reference numbers in the different figures refer to the same or equivalent elements.

DETAILED DESCRIPTION OF ILLUSTRATIVE EMBODIMENTS

The present invention will be described in relation to particular embodiments and with reference to certain drawings, however the invention is not limited to these but is limited merely by the claims.

The terms first, second and similar in the description and claims are used to distinguish equivalent elements and not necessarily to describe an order in either time or space, nor in priority or in any other way. It should be understood that the terms used in this way under certain circumstances are interchangeable and that embodiments of the invention described herein are suitable for working in a different order to that described or shown here.

In addition the terms top, bottom, above, below and similar in the description and claims are used for descriptive purposes and not necessarily to describe relative positions. It must be understood that the terms which are used here under certain circumstances may be mutually interchanged, and that embodiments of the invention described herein are also suitable for working in other orientations than described or shown here.

It must be noted that the term "comprises" as used in the claims is not to be interpreted as restricted to the means described thereafter; this term does not exclude other elements or steps. It should therefore be interpreted as specifying the presence of said features, values, steps or components to which reference is made, but does not exclude the presence or addition of one or more other features, values, steps or components or groups thereof. Hence the scope of the expression "a device comprising means A and B" should not be limited to devices which merely consist of components A and B. It means that in relation to the present invention, A and B are the only relevant components of the device.

Reference throughout this specification to "one embodiment" or "an embodiment" means that a specific feature, structure or characteristic described in connection with this embodiment is contained in at least one embodiment of the present invention. Thus the use of the terms "in an embodiment" or "in one embodiment" at various points throughout the specification need not necessarily always refer to the same embodiment, but may do so. Also, the specific features, structures or characteristics may be combined with each other in any suitable manner, as will be clear to the average expert on the basis of this publication, in one or more embodiments.

Similarly, it must be appreciated that in the description of exemplary embodiments of the invention, different features of the invention are sometimes grouped together in a single embodiment, figure or description thereof with the aim of streamlining the disclosure and assisting with the understanding or one or more of the various inventive aspects. This method of disclosure should not be interpreted as reflecting an intention that the invention requires more features than are explicitly stated in each claim. Also, as the following claims show, inventive aspects lie in less than all features of any single, previously disclosed embodiment. Therefore the claims following the detailed description are hereby explicitly included in this detailed description, with each independent claim as a separate embodiment of this invention.

Also, while some embodiments described herein include some but not other features contained in other embodiments, combinations of features of different embodiments are considered as lying within the scope of the invention and form different embodiments, as will be understood by the expert. For example, in the following claims, any of the embodiments described may be used in any combination.

In the description provided here, numerous specific details are emphasised. It should also be understood that embodiments of the invention may be formed without these specific details. In other cases, well known methods, structures and techniques are not shown in detail, to keep the description clean.

Definitions

An animal skin in the context of the present invention is the dermis and epidermis (with possible hair) of an animal. No residue of flesh and/or fat is present. The animal skins may come from mammals, birds, reptiles, amphibia or fish.

Tanning of animal skins in the context of the present invention means the conventional process wherein proteins in the animal skin are rendered indissoluble by the application of hydrolysable polymers.

Freeze-drying is a process wherein the fluid present in a substance to be dried is converted at low temperature into ice crystals which then sublimate in very dry air. In embodiments of the present invention, the ice crystals are already formed by the prior freezing of the skin. In the following step, during freeze-drying, the formed ice crystals are sublimated. Freeze-drying in the context of the present invention means the process by which an animal skin is freeze-dried in a lyophilisator until the skin is bone dry. Bone dry in the context of the present invention means that the animal skin only has residual fraction of moisture between 0 and 8% of the total weight.

Impregnation in the context of the present invention means the penetration of a material, in the context of the present invention a freeze-dried skin, with another substance, in the context of the present invention an impregnation material. The impregnation material may for example—but the invention is not restricted to this—be a resin such as for example an acrylate, a polyurethane or a silicone. Low-viscosity fluids with hardening properties may be considered as impregnation material. Typically, in the context of the present invention, this impregnation may take place by dipping the freeze-dried skin in a dispersion, emulsion or solution of the impregnation material.

DESCRIPTION

In a first aspect, the invention provides a method for processing animal skins in such a way that they display no signs of rotting for a long period and are useable for further applications. To achieve these features, no other steps such as conventional tanning are required.

The animal skin may for example come from mammals, birds, reptiles, amphibia or fish. According to the method of the present invention, preferably hair-free skins are used. Preferably skins from fish, reptiles or birds are used because the skins are thinner. Thinner skins require shorter freeze-drying times.

In order to obtain a processed animal skin, in the first place the animal skin is frozen 530. The purpose is to perform the step of freezing 530 as quickly as possible, so that the ice crystals formed from moisture from the skin are as small as possible. The speed of freezing 530 of the animal skin depends on the thickness of the skin, the mass of the animal skin and the capacity of the deep-freezer.

After this pre-cooling step, the frozen skin is freeze-dried 540, wherein the crystals previously formed are sublimated. Freezing and freeze-drying in this way ensure that the holes created in the network of dermis and epidermis are as small as possible, to reduce damage. In this way the animal skin remains as supple as possible.

In order to perform the freeze-drying 540 successfully in the manner described above, the following steps can be carried out. The animal skins are preferably brought frozen into a lyophilisator. The skins at that moment have a temperature between −1 and −50° C. Preferably, at the moment they are brought into the lyophilisator, the skins have a temperature of between −15 and −30°. In the lyophilisator, the animal skins are processed further at a temperature which is at least 10° C. colder than the starting temperature, preferably at least 20° C. colder. In this way, the samples in the lyophilisator are cooled further to a temperature of between −20 to −180° C., such as for example between −20 to −70° C., preferably to a temperature between −30 and −50° C. To ensure that as much moisture as possible is extracted from the animals skins and that the animal skin is bone dry, a low pressure e.g. a vacuum is applied in the lyophilisator. This low pressure is lower than 15 mbar throughout the complete passage time. In this way the moisture is extracted from the animal skins during the passage time.

The speed of freeze-drying 540 of the animal skin depends on the thickness of the skin, the mass of the animal skin and the capacity of the lyophilisator. In an advantageous embodiment of the present invention, preferably skins are used with thickness between 200 and 1000 microns. Freeze-drying can preferably take place during a period between 0 (not included) and 22 hours, for example between 1 minute and 8 hours, and is preferably completed within 4 hours. For a single skin, freeze-drying may for example take 14 hours. For a double skin, i.e. when two skins are placed with their inner sides against each other (for example for a fish with scales on the outside), this can take for example 22 hours.

The freeze-drying 540 of the animal skins takes place until the skins are bone dry. This means the residual moisture content in the freeze-dried skin is between 0 and 8 weight %. Preferably, the residual moisture content is between 0 and 2 weight %.

The time at which freeze-drying can be stopped may be determined automatically by measuring the moisture in the lyophilisator, for example in its receiver, and stopping the process when this moisture has fallen to a preset value. Alternatively, a user may set in advance a time for the duration of the freeze-drying, for example based on the type of animal skin, the weight of the skin and/or other experiences with freeze-drying.

During freeze-drying 540, shrinkage may occur in the animal skin. Various techniques can counter this. Before the animal skin is brought into the lyophilisator, it is cooled 530, for example by dipping in liquid nitrogen. Where applicable, the animal skin is clamped 520 during freeze-drying. Preferably, the latter technique is not necessary.

During freeze-drying, the animal skins in the lyophilisator preferably do not physically make contact with each other. This can be achieved by suspending the skins separately from each other or by providing plates on which the animal skins can lie. If the skins are however introduced in the lyophilisator in pairs, then preferably their inner sides (for a fish: the non-scale sides) lie against each other.

The result of freezing and then freeze-drying of a salmon skin is illustrated in FIG. 1. The salmon skin illustrated was first cooled to −20° C. and then freeze-dried at a lower temperature of −40° C. as described below in example 1. No impregnation was subsequently carried out with an impregnation medium. The photo clearly shows the dermis 1 and epidermis 2 of the fish. Furthermore the spongy structure with holes 3 of the dermis and epidermis is visible, the holes being formed by the pre-freezing and the freeze-drying.

According to embodiments of the invention, the animal skins are impregnated within a short time after freeze-drying 540, for example within 2 hours. Impregnation 550 may take place by dipping the freeze-dried animal skin in the impregnation material, wherein the freeze-dried skin absorbs the impregnation material. This absorption may take place by filling the various cavities which have been produced in the animal skin by freeze-drying or, in the case of some animal skins, by interaction of the animal skin with the impregnation material. In order to achieve a better impregnation 550, a pressure may be applied, for example a pressure between 1 bar and 10 bar, for example between 3 bar and 6 bar, wherein impregnation medium is pressed into the skin. After the skin has been saturated with the impregnation material, this is preferably not impregnated further. If the impregnation takes place after the skin is saturated, the processed skin may lose strength. After dipping the animal skin in the impregnation bath, the animal skin may be pressed 560, for example by being passed between two rollers in order to remove surplus impregnation material. The combination of dipping and pressing is also called Foulard rolling. During this pressing step 560, not only is surplus impregnation material removed but also part of the impregnation material is pressed into the animal skin. The skin may be greased with a fatty substance, after which the fat is absorbed and where applicable also pressed into the skin.

Other suitable techniques for impregnation 550 may be applied according to the present invention, for example atomisation of impregnation material, rubbing the impregnation material as a layer on the animal skin, or applying the impregnation material via foam application or plasma technology into the animal skin. In each of these methods, it is important that suitable measures are taken (suitable impregnation materials and techniques) so that the cavities formed by freeze-drying 540 are adequately filled by the impregnation material.

According to embodiments of the present invention, a combination of the above mentioned impregnation processes may be used to bring the impregnation material into the freeze-dried skin.

Suitable impregnation materials according to embodiments of the present invention are amongst others polyacrylates, polyesters, polyurethanes, silicone materials, polyvinyl alcohols, polyvinyl acetates, polyvinyl chlorides, synthetic resins, starch derivatives, oils, natural resins, natural waxes. Also functional agents may be added to these impregnation materials such as colourings and fragrances.

In particular for example, an acrylate dispersion may be used. This has the advantage that it is easily absorbed by the freeze-dried animal skin. The skins treated in this way then also display sufficient strength properties for further processing, a high UV resistance and high resistance to moisture.

According to embodiments of the present invention, within a short time after freeze-drying 540, the animal skins are impregnated. Freeze-dried animal skins 540 which remain too long in an environment, with or without moisture, always reabsorb ambient moisture and have a higher moisture content after a lapse of time. As a result it is more difficult to impregnate the animal skins 550 such that all cavities on the inside are coated or filled. In a preferred form of the present invention, the freeze-dried animal skins are impregnated 550 when they are bone dry, preferably at the latest 2 hours after freeze-drying, depending on climatological conditions. Preferably, the skins are impregnated within 30 minutes after freeze-drying.

Impregnation 550 firstly ensures that the animal skins have a certain stiffness because the cavities in the animal skin are filled. Also, the elasticity and flexibility of the freeze-dried animal skins 540 can be greatly improved by impregnation 550, which facilitates further processing of the animal skins into useful objects. But above all, it is an important benefit of impregnation of the freeze-dried animal skins according to the invention that this method has a very short passage time, can take place locally, and ecologically entails no waste. The steps of conventional tanning need not be carried out. With this method, a product is obtained with at least the same properties as tanned skin. The processed skins are however easier to manipulate, stronger and more resistant to cracking.

According to the present invention, after undergoing the above steps, the animal skin is supple, strong, resistant to cracking and rot-free. This means that the animal skin is completely processable and can be used in further applications, such as for example, but without limitation, utensils, interior applications, clothing and in the car industry.

It is an advantage that the skin obtained can later still be formed by e.g. rewetting the skin obtained. It is an advantage that the skin obtained can be clamped or pressed onto a desired substrate. It is for example possible to clamp the skin obtained around a bicycle saddle or around the last of a shoe. By clamping the skin, the desired form can be obtained. This flexibility of the skin is obtained because it is processed according to a method of the present invention, whereby it becomes thicker, flexible and has more stretchability. The clamped skin can be fixed by means of acrylate or silicone to the substrate.

A treated animal skin according to embodiments of the present invention can fulfil its function in use over several years, without any occurrence for example of rotting and colour loss, provided that it does not come into contact with severely contaminating environmental factors, such as impact forces which damage the material.

Example

The invention will now be explained further with reference to the following example, without being restricted thereto.

The first example concerns processing of a fish skin, more specifically a salmon skin. The method for obtaining a processed salmon skin is described below together with the specific properties of the material after processing.

To process a salmon skin according to the present invention, first the salmon is filleted. Of the fish skin, this leaves only the dermis and epidermis. This is a salmon skin with scales, but free from fat and flesh. The salmon skin in this case had a weight of 19 grams and a thickness between 350 and 500 microns. This salmon skin was introduced into an Edward Modulyo Pirani 10 lyophilisator. By pre-cooling, the salmon skin had a temperature of −20° C. on introduction into the lyophilisator. The salmon skin was freeze-dried 540 at a temperature of −40° C. This took place during 4 hours, wherein the low pressure applied for the entire time was 10 mbar. At the end of the process, the salmon was bone dry with a residual moisture content of 1%. The salmon skin after freeze-drying weighed 9 grams.

Immediately after freeze-drying 540, the salmon skin treated in this way was impregnated via a full bath treatment. The salmon skin was introduced into a full bath with an acrylate dispersion which, in this specific example, consisted of 60 parts Acrilem 374, 20 parts xylene and 20 parts water.

Figure 2:
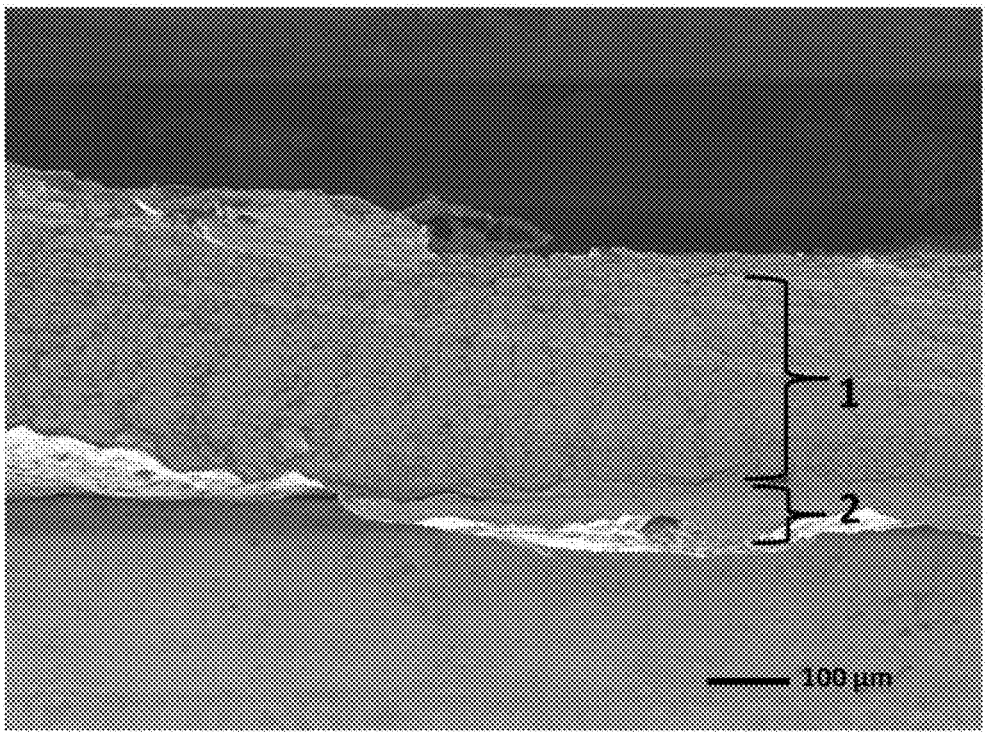
FIG. 2 is a cross section of a freeze-dried salmon skin as shown in FIG. 1. The salmon skin has been subsequently impregnated with an impregnation medium according to example 1. The photo shows slightly less clearly the dermis (1) and epidermis (2) of the fish. It can also been seen that the holes of the spongy structure have been fully filled.

The salmon skin was introduced into the full bath for 1 hour. Thus the cavities left by freeze-drying were filled and the surface assumed a treated aspect. The final weight of the treated salmon skin was 12 grams. The salmon skin treated and obtained in this way can be used for further applications. A cross section of such a treated salmon skin in shown in FIG. 2. It is clear that in relation to the initial freeze-dried salmon skin 540 in FIG. 1, the spongy structure is completely filled with acrylate.

The salmon skin thus obtained was tested further in various ways. The maximum tensile strength was determined to ASTM D5035. In the length direction of the fish, a mean maximum force of 512 N was measured. The shear strength of the resulting salmon skin was then measured. This was determined using EN 388-6.3. The maximum mean shear strength peak was 24.6 N. Then the abrasion was measured according to ASTM D4996-1, Martindale. The resulting salmon skin on all samples survived 100,000 cycles. A final strength test applied to the salmon skin was the resistance to perforation. The skin was tested to EN 863. The mean perforation resistance was 48 N.

The absorption capacity of the resulting salmon skin was then also determined. This was done to DIN 53923. The samples show a water absorption of 48.5%, which is relatively high despite the filling with acrylate.

The second example concerns processing of a fish skin, more specifically a salmon skin. The method for obtaining a processed salmon skin is described further below, together with the specific properties of the material after processing.

To process the salmon skin according to the present invention, first the salmon is filleted. Of the fish skin, this leaves only the dermis and epidermis. This is a salmon skin with scales, free from fat and flesh. The salmon skin had a weight of 50 grams (determined by the size of the salmon skin piece) and a thickness between 350 and 500 microns. This salmon skin was frozen and introduced into an Edward Modulyo Pirani 10 lyophilisator. On introduction into the lyophilisator, the salmon skin had a temperature of −30° C. The salmon skin was freeze-dried 540 at a temperature of −50° C. This took place for 3 hours, wherein the low pressure applied during the entire passage time was 9 mbar. At the end of this process, the salmon skin was bone dry with a residual moisture content of 1%. After freeze-drying 540, the salmon skin weighed 19 grams, slightly less than half.

Immediately after freeze-drying 540, the salmon skin treated in this way was impregnated by full bath treatment. The salmon skin was introduced into a full bath with a commercial leather processing product based on paraffin oil, Vaseline, beeswax and palm wax.

Figure 3:
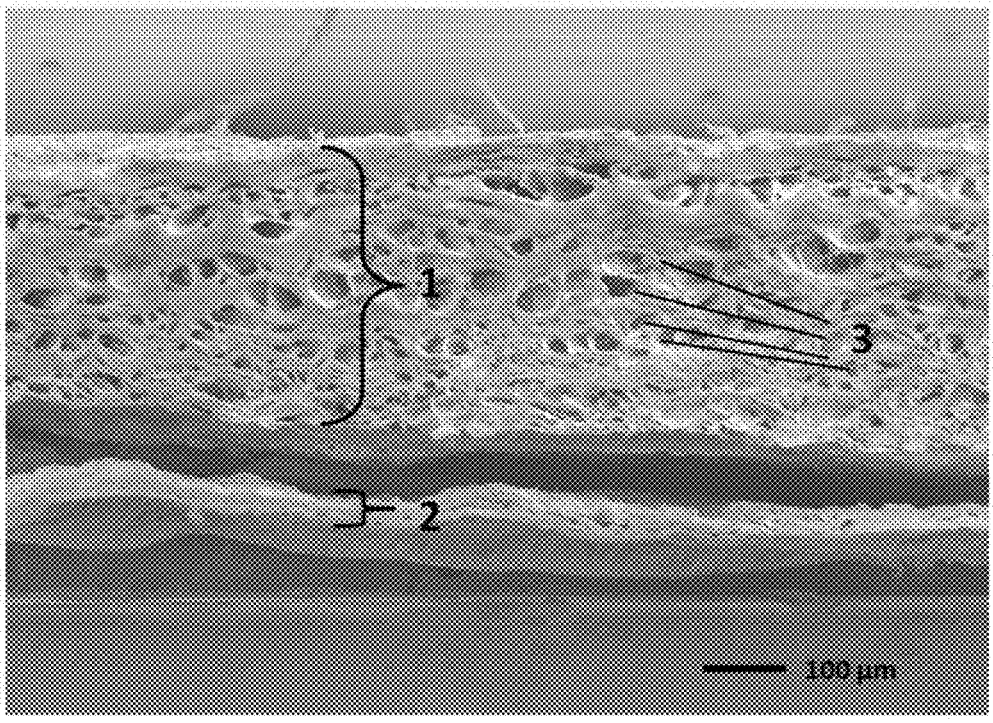
FIG. 3 is a cross section of a salmon skin which has been frozen and then freeze-dried according to embodiments of the present invention. This salmon skin has been subsequently impregnated with an impregnation medium according to example 2. The photo clearly shows the dermis (1) and epidermis (2) of the fish. It can also be seen that the holes of the spongy structure (3) are free and more open than in FIG. 1.

The salmon skin was introduced into the full bath for 1 hour. The cavities left by the freeze-drying were filled and the surface assumed a treated aspect. The final weight of the treated salmon skin was 19 grams. The treated salmon skin obtained in this way can be used for further applications. A cross section through the treated salmon skin is shown on FIG. 3. It is clear that in relation to the initial freeze-dried salmon skin in FIG. 1, the spongy structure is retained. This is because of the waxing, which does not form a closed coating. The fish skin obtained is much more supple and softer to feel than the skin in example 1.

Comparison

Figure 4:
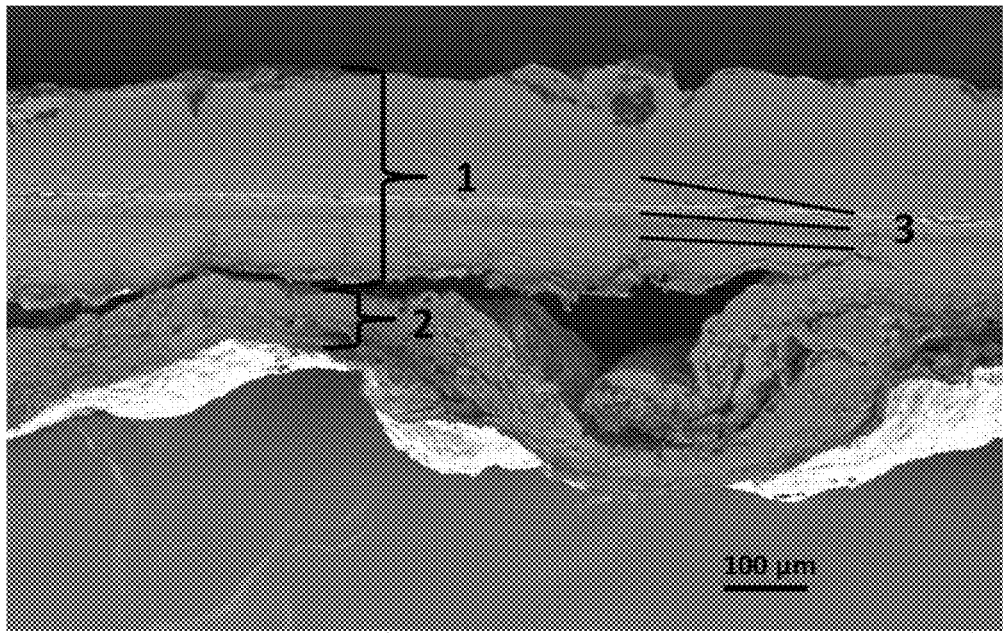
FIG. 4 is a cross section of a salmon skin. The salmon skin is clamped and directly freeze-dried at −40° C. No pre-cooling to −20° C. has taken place. On the photo it is clear that the dermis (1) and the epidermis (2) of the fish are present. It also clear that the spongy structure with holes (3) of the dermis and epidermis is not present.

Salmon skin A described in this comparison is a salmon skin which was made for comparison without being cooled before being freeze-dried. For this the salmon was first filleted. This left only the dermis and the epidermis of the fish skin. This is a salmon skin with scales, free from fat and flesh. In this case the salmon skin had a weight of 30 grams (weight determined by the size of the skin) and a thickness between 350 and 500 microns. The salmon skin was introduced into an Edward Modulyo Pirani 10 lyophilisator. On introduction into the lyophilisator, the salmon skin had a temperature of 20° C. This salmon skin was not pre-cooled. The salmon skin was freeze-dried at a temperature of −40° C. This took place for 4 hours where the low pressure applied during the complete passage time was 10 mbar. At the end of the process, the salmon skin was bone dry with a residual moisture content of 1%. After freeze-drying the salmon skin still weighed 15 grams, which was half the original weight. A cross section of salmon skin A is shown in FIG. 4.

Figure 6:
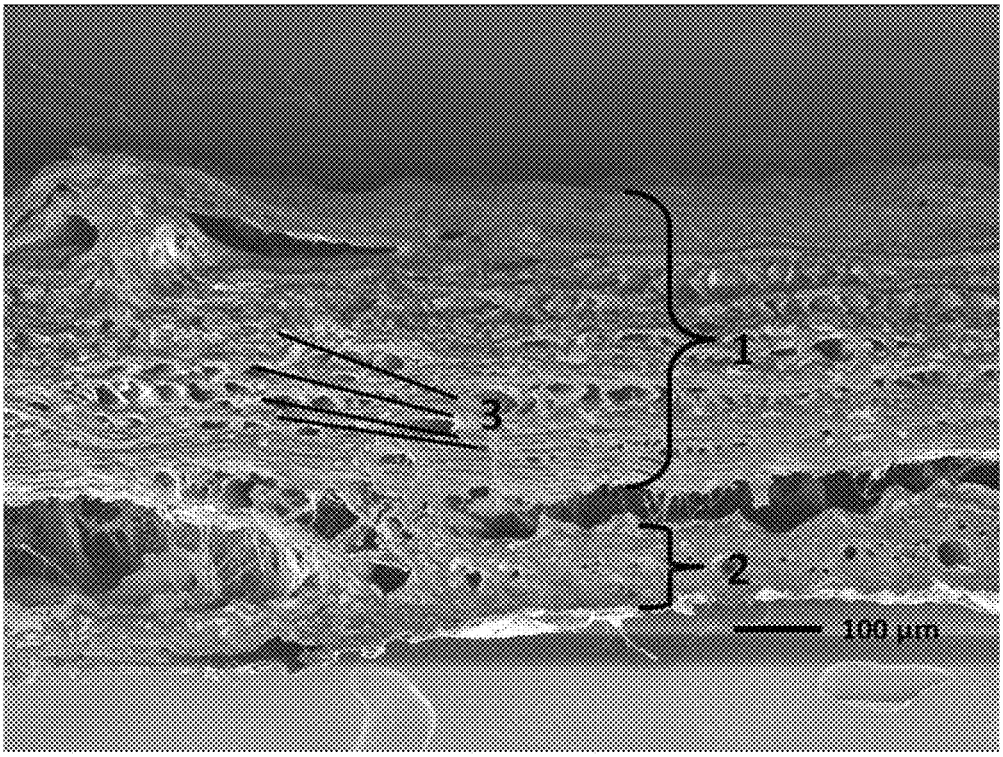
FIG. 6 is a cross section of a freeze-dried salmon skin according to embodiments of the invention. This salmon skin has first been cooled to −20° C. and then freeze-dried at a lower temperature of −40° C. as described in example 1. No subsequent impregnation has yet been carried out with an impregnation medium. The photo clearly shows the dermis (1) and epidermis (2) of the fish. Furthermore the spongy structure with holes (3) of the dermis and the epidermis is visible.

For comparison, salmon skin B was produced in the same procedure as described above except that, before salmon skin B was placed in the lyophilisator, this salmon skin was first cooled to a temperature of −20° C. in accordance with the embodiments of the present invention. The cross section of salmon skin B can be seen in FIG. 6.

There were surprising differences between salmon skins A and B. Salmon skin A was much stiffer and rougher to feel than salmon skin B. Salmon skin B had more of the desired suppleness.

The resulting unimpregnated salmon skins were tested further in relation to each other. The maximum tensile strength was determined via ASTM D5035. In the length direction of the fish, there were considerable differences in relation to the two methods. In the length direction of salmon skin A, the average maximum force is 604 N. In salmon skin B, the average maximum force was 348 N. This shows that salmon skin A was slightly stiffer (more difficult to deform) than salmon skin B according to the invention. Then the shear strength of the two salmon skins was determined with EN 388-6.3. The mean maximum shear strength of salmon skin A was 20 N, that of salmon skin B 28 N. Salmon skin A, in other words, is coarser than salmon skin B and will crack more easily. Both tests show that salmon skin A was stiffer and more brittle than salmon skin B, and consequently more difficult to handle and process. By using the method according to embodiments of the invention, wherein the skin is frozen before being freeze-dried, the skin was made more suitable for further processing. By adding an impregnation medium to the skin, certain physical properties of the skin can be influenced further in the desired manner (but this was not included in the comparative test).

The suppleness of the salmon skins was tested via ISO 7854. 100,000 turns were run on the Crumpleflex and the aspect loss was measured. It was clear after the test that salmon skin B only had a slightly aspect loss, without the occurrence of cracks or wrinkles. In contrast, salmon skin A had a greater aspect loss wherein permanent wrinkles were clearly visible and cracks occurred. There is therefore a clear difference between the salmon skins obtained via the two methods.

Figure 5:
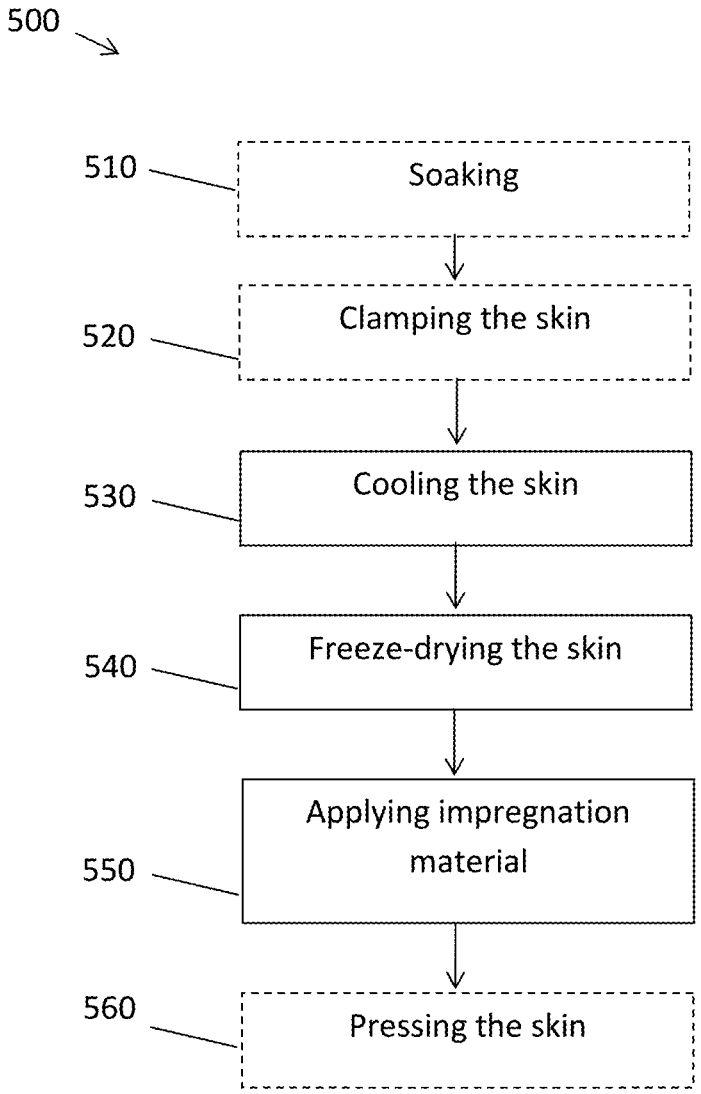
FIG. 5 shows the various possible steps of a method for treating skins in accordance with embodiments of the present invention.

FIG. 5 shows the various possible steps of a method (500) for treating skins in accordance with embodiments of the present invention. The necessary steps are freeze-drying (540) of the skin and application (550) of an impregnation material into the freeze-dried skin. These steps may be preceded by a step in which the skin is clamped (520) and a step in which the skin is cooled (530). The skin may be soaked (510) before being cooled (530) and/or clamped (520). After application (550) of the impregnation material, a step may follow in which the skin is pressed (560). In this step, impregnation material is pressed into the skin and the surplus quantity of impregnation material is removed.

It is clear from the description above that, according to the present invention, freeze-drying is used as a replacement for conventional tanning steps and not as an additional step on top of conventional tanning steps. Although both freeze-drying and conventional tanning steps were already known before the present invention, insofar as the inventor has found, no one has previously seen that only the freeze-drying steps need be performed in order to obtain a processed animal skin with good properties (conservability, strength) and that the conventional tanning steps are then superfluous.

The description above gives details of certain embodiments of the invention. It will however be clear that, however detailed the above appears in the text, the invention can be used in many ways. It must be noted that the use of certain terminology in the description of certain features and aspects of the invention must not be regarded as implying that the terminology herein is redefined to be restricted to specific features of the characteristics or aspects of the invention with which this terminology is associated.

The invention claimed is:

1. A method for processing skin, the method comprising:

freezing of the skin before freeze-drying the skin, freeze-drying of the skin, application of an impregnation material into the freeze-dried skin while being in a freeze-dried state, the impregnation material comprising one or more of the following components: acrylates, polyacrylates, polyesters, polyurethanes, silicone material, polyvinyl alcohols, polyvinyl acetates, polyvinyl chlorides, synthetic resins, starch derivatives, oils, natural resins, natural waxes.

2. A method according to claim 1, wherein the freeze-drying takes place at a temperature between −20° C. and −180° C.

3. A method according to claim 1, wherein the skin is frozen by being dipped in liquid nitrogen.

4. A method according to claim 1, wherein the skin is freeze-dried at a temperature which is at least 10° C. colder than the temperature of the skin at the start of freeze-drying.

5. A method according to claim 1, wherein the freeze-drying takes place at a pressure lower than 15 mbar.

6. A method according to claim 1, wherein the freeze-drying takes place until the residual fraction of moisture in the skin is less than 8% of the total weight of the skin before freeze-drying.

7. A method according to claim 1, wherein the impregnation material is applied in a bath, where applicable under pressure, and/or wherein the impregnation material is applied by atomisation onto the skin, and/or wherein the impregnation material is applied by rubbing onto the skin, and/or wherein the impregnation material is applied via a foam application to the skin.

8. A method according to claim 1, wherein after application of the impregnation material, the impregnated skin is pressed.

9. A method according to claim 1, wherein the duration of the freeze-drying is reduced by lowering a pressure when freeze drying the skin or by accelerating the cooling.

10. A method according to claim 1, wherein the impregnation material is applied within at most 2 hours after freeze-drying of the skin.

11. A method according to claim 1, wherein the skin is clamped before being freeze-dried.

12. A method according to claim 1, wherein functional agents including colourings, fragrances and/or an acrylate dispersion are added to the impregnation material.

13. A method according to claim 1, applied to a skin with a thickness between 200 and 1000 microns.

14. A method according to claim 1, wherein the skin is soaked before being frozen.

* * * * *